United States Patent [19]

Simon

[11] 4,235,497

[45] Nov. 25, 1980

[54] SPRING CONTACT ELEMENT AND INSULATING CASE THEREFORE

[76] Inventor: Hans Simon, Bruchhausener Strasse, 5463 Unkel, Rhein, Fed. Rep. of Germany

[21] Appl. No.: 886,339

[22] Filed: Mar. 14, 1978

[30] Foreign Application Priority Data

Mar. 17, 1977 [DE] Fed. Rep. of Germany ..... 2711709

[51] Int. Cl.[3] ..... H01R 13/28

[52] U.S. Cl. ..... 339/47 R; 339/252 R

[58] Field of Search ..... 339/252 R, 47–49, 339/217 S

[56] References Cited

U.S. PATENT DOCUMENTS

| | | | |
|---|---|---|---|
| 538,423 | 4/1895 | Koenig et al. | 339/252 R |
| 2,762,022 | 9/1956 | Benander et al. | 339/47 R |
| 3,146,051 | 8/1964 | Woofter et al. | 339/49 R |
| 3,397,383 | 8/1968 | Prifogle et al. | 339/252 R |
| 3,683,316 | 8/1972 | Wolf | 339/252 R |

FOREIGN PATENT DOCUMENTS

| | | | |
|---|---|---|---|
| 2538395 | 3/1976 | Fed. Rep. of Germany | 339/47 R |
| 791913 | 3/1958 | United Kingdom | 339/47 R |

*Primary Examiner*—Joseph H. McGlynn
*Attorney, Agent, or Firm*—John S. Roberts, Jr.

[57] ABSTRACT

Spring contact element comprising a metal spring leaf for mechanically fastening and electrically connecting it to the end of a cable and a contact spring to provide a plug-in connection with a counter contact element wherein said contact spring includes a base leg attached to the fastening means and passing, at the plug-in end of said spring contact element, via a bend having a predetermined bending radius, into a free end leg describing an acute angle with the base leg, and an insulating case for such spring contact element wherein a first contact chamber to receive said spring contact element through an opening in a first front side and a second contact chamber to receive said counter contact element from the second front side facing said first front side are provided and the broadside of the cross section of said second second contact chamber is twisted about 90° against the broadside of the cross section of said first contact chamber and said two contact chambers penetrate each other symmetrically.

38 Claims, 29 Drawing Figures

FIG. 16.
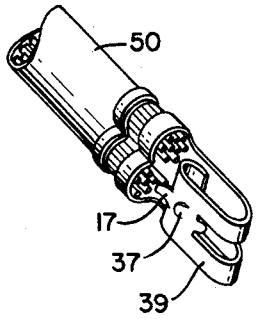
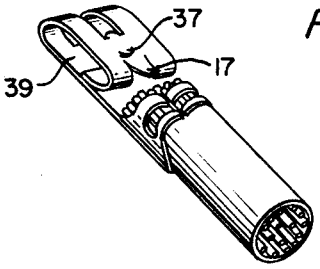
FIG. 17.
FIG. 18.
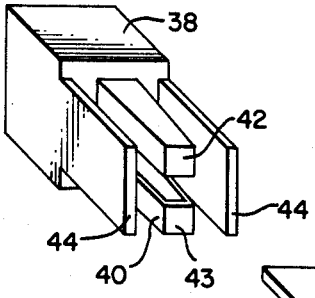
FIG. 19.
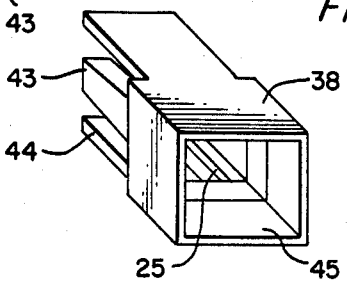
FIG. 20.
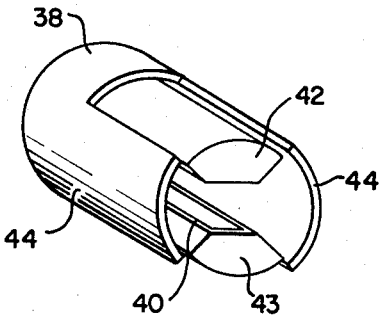
FIG. 21.
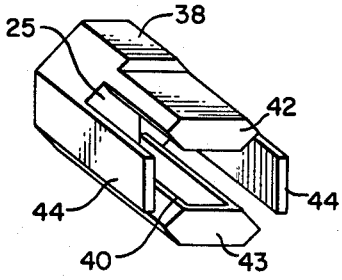

SPRING CONTACT ELEMENT AND INSULATING CASE THEREFORE

The invention relates to a spring contact element comprising a metal spring leaf, fastening means for mechanically fastening and electrically connecting it to the end of a cable, and a contact spring to provide a plug-in connection with a counter contact element. The invention relates particularly to spring contact elements which may be pressed against electric conductors and which may be plugged into the space between a contact tongue. The invention relates further to an insulating case to receive the spring contact elements of the invention which insulate an electric connection of the contact against the outside.

Prior art spring contact elements constitute one half of an electric plug-in connector whose second half is mostly shaped as either a pin or flat plug-in tongue. In order to obtain a connection, the flat plug-in tongue is inserted, under a light contact pressure, into the spring contact. The electric conductor is preferably pressed against the corresponding half of the plug-in connection with the aid of a warp connection.

From U.S. Pat. No. 3,874,769, a spring contact element has been known which is inserted and slid on a flat contact sheet. This prior art spring contact element cannot be plugged in and, it is therefore not suited for the production of symmetrical plug-in connections comprising two identical spring contact elements.

Electric plug connections have further been known which comprise plane plate bars having a broken-away portion the edges of which are chamfered on the two sides at 45° so that two of these plate bars may, in the area of these chamferings, be plugged into each other. A particular disadvantage of such electric plug-in connections is the insufficient spring property of the plate bars and the necessitated close production tolerances which cause high production expense.

It is the aim of the present invention to provide simple, economical spring contact elements of metal spring leaf which remains unimpaired even within relatively great production tolerances and the shape makes possible the provision of an electrically and mechanically stable connection of two identical, or substantially identical, elements which have good lasting spring properties and requires little force to connect one to the other. It is a further aim of the invention to provide associated insulating cases in which the spring contact elements may easily be inserted and mechanically secured for mono or multipolar connection.

The prior art problems are solved with the aid of a spring contact element of a metal spring leaf comprising fastening means for mechanically fastening and electrically connecting it to the end of a cable, and a contact spring to provide a plug-in connection with the counter contact element which is characterized in that the contact spring includes a base leg attached to the cable fastening means and extending to a plug-in end formed by a bend having a predetermined bending radius, terminating in a leg having a free end describing an acute angle with the base leg.

The acute angle between base leg and free end leg corresponds to about the reset angle which the end leg possesses when released after it has been bent in the course of the production up to contact with the base leg, i.e. at about 180° away from the plug-in side, the length of the end leg preferably corresponding to about the length of the base leg.

The spring properties obtained in this way have their optimum as concerns life and uniformity; they may be varied relative to the elasticity for instance by providing a suitable bending radius at the bend between base leg and end leg.

The base leg and the free end leg possess preferably the same width perpendicular to the plug-in direction.

The fastening means by which the spring contact element is mechanically fastened to one conductor end of a cable and electrically connected to the conductor includes preferably a conductor wrapping means on the side of the cable which is directly adjacent to the base leg and can be wrapped on the bare end of the cable. On the side of the cable there is preferably provided, in addition the conductor wrapping means, an insulating wrapping means with the aid of which the spring contact element is secured to the insulating sheath. The two wrapping means are preferably provided, relative to the plane of the base leg, on the same side as the end leg.

In a further preferred embodiment of the invention, the wrapping devices are so arranged that the cable axis is provided in a plane perpendicular to the plug-in direction. In this way, angle spring contact elements are obtained which are necessary for the production of angled electrical connections.

In place of the wrapping devices, other fastening means, for instance soldered connections etc., are preferably provided if the spring contact element is either to be soldered onto the bare conductor end of an insulated cable or is to be employed together with the conductor ends of other conductor types, for instance belt or strip conductors etc. as used on plate bars.

In a preferred embodiment of the spring contact element of the invention, there is provided at the free end of the end leg, at least one support yoke limiting the spring deflection of the end leg relative to the direction of the base leg. In order to produce such support yokes, the free end of the end leg is preferably bent, or rolled, at about 180° against the base leg and the plug-in side of the spring contact, the bend having a bending radius which is preferably somewhat smaller than the bending radius of the bend between the base leg and the end leg of the plug-in side of the spring contact element. Such support yokes permit the employment of the free end leg without overbending; they make further possible a contact of the free end leg, i.e. an increase of the current-conducting cross section within the contact area and an enforcement of the contact pressure of the plug-in connection.

The spring contact is preferably plugged into a correspondingly dimensioned plug-in slot in a belt-shaped counter contact element or flat plug, the broadside of the flat plug being arranged perpendicular to the broadside of the contact spring of the spring contact element. The contact springs of the spring contact elements according to the invention thus are not plugged in as usual but are rather plugged into a slot, or broken away portion, in metal plate bars or flat plugs or metal plug-in tongues. A further bending which could cause an early decrease of the contact pressure is thereby avoided. Even if heated, no decrease of the contact pressure will be experienced as the expansion caused by heating will increase rather than decrease the contact pressure. Also, the connection will not become inoperable if subjected to a not too intense overload.

The support yokes are preferably so arranged that they support the spring contact, in the plugged-in state, within the plug-in slot of the slotted counter contact element or of the corresponding plate bar.

In a preferred embodiment of the spring contact element of the invention, there is provided at the side edges of the free end of the end leg, one support yoke each, between which a free stop notch or free tongue is provided, which when pressing the spring contact to the bare conductor end of an electric cable, not only protects the wires from damage but also increases the conducting cross section thereof.

The contact tongue between the two support yokes provided on the outer edges may preferably be so shaped that it is directed under the bare conductor end of the cable and is pressed on in this location thus giving the same advantages as are obtained in case of a contact tongue disposed above the bare cable wire.

In a further preferred embodiment, only one support yoke is provided in about the middle of the free end of the end leg. On this support yoke, there is arranged a contact spring tongue extending to the cable side of the spring contact element, it is also directed, in the course of the fastening of the spring contact element on the cable, under the bare conductor end of the cable and is also pressed on it.

At the free end of the end leg, there may preferably be provided a locking spring, directed away from the end leg, into which the spring contact element may engage within the chamber of a surrounding insulating case so that the spring contact element is mechanically locked within the insulating case.

In a preferred embodiment of the invention, there may be provided, on the outwardly directed contact faces of the base leg and/or the end leg, contact skids to receive the counter contact element of an electric plug-in connection. The contact skids are preferably directed in the plug-in direction and are flexibly attached to the side edges of the base leg and/or the end leg, the contact skids pressing flexibly against the side faces of the counter contact element.

In a particularly preferred embodiment of the invention, there is provided, from the plug-in side, one slot each in plug-in direction up to about the middle of the base leg and of the end leg, the slots in the base and in the end leg being arranged in parallel alignment one above the other relative to the base and end leg. The inner edges of the slots are preferably chamfered in the bend connecting the base leg and the end leg while the end of the slots on the side of the cable is inwardly chamfered.

The insulating cases used in conjunction with the spring contact elements according to the invention are characterized in that a first contact chamber receives the spring contact element through an opening of a first front side and a second contact chamber receives the counter contact element through an opening of a second front side facing said first front side with the broadside of the cross section of the second contact element being rotated about 90° against the broadside of the cross section of said first contact chamber, in order that the two contact chambers may penetrate each other symmetrically relative to each other.

The second contact chamber opens preferably on the second front side in an inserting slot provided with chamfered sides to facilitate insertion of the counter contact element which is provided as a flat plug having a slot to receive the spring contact element. The second contact chamber has preferably a height which is continuously decreasing from the insertion slot in the second front side to the front faces at the chamber end, while the broadside of the contact chamber which receives the broadside of the flat plug remains constant over the total length of the chamber. Because of the tapered shape of the chamber, a good guidance of the flat plug, when inserting it into the second contact chamber, is guaranteed.

The front faces at the end of the second contact chamber facing the first front face of the insulating case serve preferably as a counter support for the stop notch of the spring contact element which is inserted from the first front side into the contact chambers penetrating each other.

The front face of the first contact chamber facing the inserting slot serves preferably as a stop for the spring contact element inserted through the opening in the first front side of the insulating case so that the spring contact element is prevented from slipping through. The spring contact is consequently contact-safely arranged within the insulating chamber into which leads only, from the insertion side for the spring contact element, the insertion slot having large-dimensioned chamferings. By applying, as in accordance with the invention, the contact chambers having dimensions slightly greater than are necessary for housing the contact elements, it is guaranteed that the slotted flat plug will not contact any edges or projecting structural portions of the spring contact when being inserted so that the spring contact is not damaged. This insures an optimum contact plug-in within an optimum insulating housing.

In a further preferred embodiment of the insulating case, the first chamber extends, to receive the spring contact element, to the second front side of the insulating case. The chamferings in front of the first chamber serve as a stop for the spring contact to limit the insertion against which the fastening means of the spring contact element abuts. The embodiments hitherto described are particularly suited for multi-terminal plug-in connections on slotted switching device plug-in tongues; as the spring contacts all those embodiments may be used which are suited for plugging into flat plugs.

A further particularly preferred embodiment of the insulating case of the invention relates particularly to the embodiment of the spring contact element which is provided, on the plug-in side, with breaks in the base and in the end legs and is suited for the production of a symmetric plug-in connection comprising two identical spring contact elements. The insulating case for such spring contact elements includes preferably a base body comprising, on the side of the cable, a front side and a contact chamber provided in the base body perpendicular to the front side, on the side of the cable, to receive the spring contact element from the front side on the side of the cable. The contact chamber comprises, on the plug-in end of the base body, a rectangular interior cross section and extends away from the base body while the rectangular interior cross section receives and retains the contact spring of the spring contact element. Two side walls defining the contact chamber and facing each other include a slot to receive a counter contact element which is preferably identical to the spring contact element received by the insulating case. The slot is perpendicular to the parallel interior surfaces of the two side walls in the plug-in direction and divides the contact chamber in the plug-in end into two housing facing each other.

The slot running on the plug-in side through the contact chamber is preferably covered on both sides by a covering wall each against the outer space.

The surfaces of the cups facing the interior of the contact chamber include preferably notches provided with chamferings engaging behind the contact spring of the inserted spring contact elements locking them against a shift in the direction of the cable.

In accordance with a first preferred embodiment of the insulating case, the base body of the insulating case comprises a square outer cross section. The outer cross section of the contact chamber is preferably rectangular, the two housings being thin-walled and provided on a plane with the cable axis and parallel to one of the side walls. The covering walls which have a preferably thin rectangular cross section and constitute an elongation of the side walls of the base body are provided parallel to and in a predetermined distance to the broken side-walls of the cups. The longer edges of the cross section of the covering walls are preferably so dimensioned that the upper housing, the slot, and the lower housing are laterally completely covered by the covering walls.

In accordance with a further preferred embodiment of the insulating case of the invention,, the base body of the insulating case possesses a circular outer contour. In this embodiment, the outer contour of the two housings as preferably also the shape of a circular segment the radius of which is smaller for a given value than the radius of the base body. The inner contour of the cup directed to the interior of the contact chamber follows the circular outer contour along an inclined plane passing through the cylinder axis and subsequently in parallel to a straight edge of the inner contact chamber cross section. The covering walls are preferably shaped as a thin-walled circular segment having a constant wall thickness, the radius of the outer contour of the covering walls corresponding to the radius of the base body and the radius of the inner contour to that of the outer contour of the cups. The circular segments of the outer contour of the cups and of the covering walls each describe an arc angle of about 90°.

In accordance with a further preferred embodiment of the invention, the outer contour of the cross section of the insulating case base body is shaped as a regular octagon. The outer contour of the two housings has a first outer face staggered for a given measure to the inside relative to one of the faces of the octagon. The inner contour of the housing follows, subsequent to the outer contour, an inclined plane passing through the symmetrical axis and subsequently in parallel to the first outer face. The covering walls have preferably a thin rectangular cross section and constitute an elongation of one of the outer faces of the octagon of the base body. The thickness of the covering walls corresponds preferably to the given measure for which the first outer face of the two housings have been staggered to the inside in parallel to one octagon face of the base body. The central angle confined between the connecting lines from the outer edges of the cup cross section to the symmetric axis amounts to about 90°.

The covering walls and the cups have preferably the same length. The insulating case consists preferably of a viscous plastic material and is made in one piece.

In the three preferred embodiments of the insulating case as described in the foregoing, that is the embodiment having a square, a circular, and an octogonal cross section of the base body, the housings and the covering walls form a profile which may receive, as a second coupling portion, an identical profile rotated about 90° of a second identical insulating case the plug-in side of which is turned against the plug-in side of the first insulating case. The whole contact chamber of two insulating cases plugged against each other comprises one horizontal and one vertical half each, into which one horizontal, or one vertical, respectively, spring contact element may be inserted and plugged in. As the spring contact elements, such embodiments are employed which may be used as twin plugs, i.e. such plugs which make possible a plug-in connection of two identical spring contact elements rotated about 90°.

The individual insulating cases according to the invention may be combined in groups to constitute an integral housing for a multi-terminal plug-in connection. In this embodiment, a plurality of individual insulating cases are arranged in parallel in a plane. In accordance with a further preferred embodiment, a plurality of such planes comprising individual insulating cases may be arranged one above the other thereby increasing compactness of the combined housing relative to planar combined housings.

In such plug-in housings, a first group of individual insulating cases is preferably arranged in a predetermined angular position relative to the plug-in plane. A second group of individual insulating cases is additionally provided, axially staggered about 90° relative to the angular position of the first group. The succession of the individual insulating cases of the first and of the second group is so provided that a second housing profile identical to this first housing profile, may be plugged, after rotating about 180° relative to the plug-in direction, into the first housing profile to provide a multiple plug-in connection. Such housing systems may additionally include a guide pin each on one plug-in side and a corresponding recess for this guide pin on the side facing said guide pin.

Multiple terminal insulating cases of the kind described are non-interchangeably coded in spite of the identical structure. This is reached by the employment of an equal number of horizontal and vertical contact chambers which has the consequence that on the front side in the direction towards each other a horizontal and a vertical chamber each are facing each other and may be plugged into each other. This coding is made possible by plugging the spring contact elements as well as the corresponding insulating cases in an arrangement axially staggered about 90° relative to each other.

In the following, the invention will be explained in more detail based on exemplified embodiments and in connection with the attached drawings, wherein

BRIEF DESCRIPTION OF THE DRAWINGS

FIG. 16 is a view showing an upright spring contact element of FIG. 13, pressed against an electric cable, FIG. 17 is a view showing a horizontal spring contact element of FIG. 13 secured to an electric cable, FIG. 18 is a perspective view of a one-terminal insulating case for a spring contact element of FIG. 13, FIG. 19 is a rear view of the insulating case shown in FIG. 18 rotated about 90°, FIG. 20 is a view showing a second embodiment of an insulating case for the contact of FIG. 15 according to the invention, FIG. 21 is a view showing a third embodiment of an insulating case for the contact of FIG. 15 according to the invention.

DESCRIPTION OF THE PREFERRED EMBODIMENT

Figure 1:
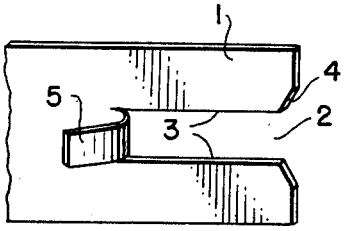
FIG. 1 is a view showing a counter contact element shaped as a flat plug and having an insertion slot.

With reference to the drawings, FIG. 1 shows a counter contact element which may be employed as a slotted flat insertion tongue or plug 1, having spaced parallel arms 3, 3 defining a slot 2 therebetween. Chamferings 4 are provided on the arms 3, 3 adjacent slot 2 to facitate the of a spring contact element. A stop tongue 5 is provided at the end of the insertion slot and consists of the material from which slot 2 has been.

Figure 2:
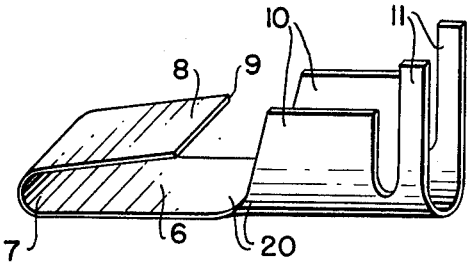
FIG. 2 is a view showing a first embodiment of a spring contact element.

FIG. 2 shows a first embodiment of 2 spring contact element designated as 20 and includes cable securing means 10, 11 at one end to mechanically and electrically connect it to a cable and at the other end a flat contact spring 6, 7, 8,9 adapted to be received in the slot 2 of the counter contact element. As seen the base leg 6 extend from the securing means 10, 11 and passing, in a flat plane and curves upwardly by a bend 7 of a given bending radius terminating on a free end leg 8, which acts as a leaf spring and defines an acute angle relative to base leg 6. The acute angle between base leg 6 and free end leg 8 corresponds preferably to the reset angle which the end leg 8 possesses when released after it has been bent in the course of the production of the contact. End leg 8 has a somewhat decreased length relative to base leg 6 while the widths thereof are substantially the same.

Cable securing means 10, 11 include respectively conductor wrapping means 10 which engages and secures to the bare conductor ends of a cable 50 while wrapping means 11 engages and secures the cable insulation to the contact element 20. Instead of the wrapping means, other suitable securing means such as soldering lugs, etc. may be provided which can, integrally or separately, be produced with the spring contact element.

Figure 3:
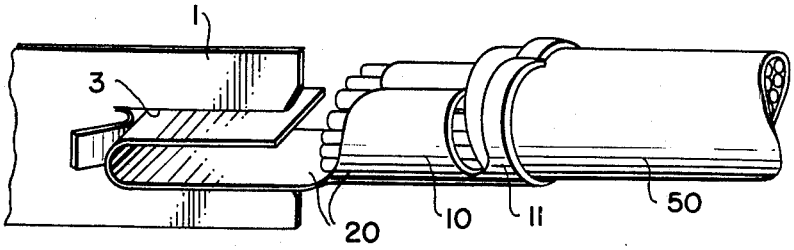
FIG. 3 is a perspective view showing an electric connection of contact elements shown in FIGS. 1 and 2.

The connection between contact elements of FIGS. 1 and 2 is shown in FIG. 3 with the slot 2 receiving to FIG. 2 has been inserted which is pressed, with the two warping means 9, 10, to the end of a cable 50. When inserting free end leg 8 and base leg 6 therebetween by are slightly pressing the same together with the base leg 6 and end leg 8 resiliently braced against edges of arms 3 and thus provide an electrical connection between two elements.

Figure 4:
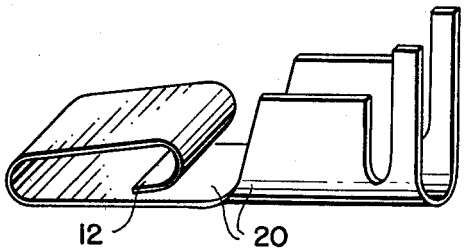
FIG. 4 is a view showing a further embodiment of the spring contact element with a rolled-in support yoke.
Figure 5:
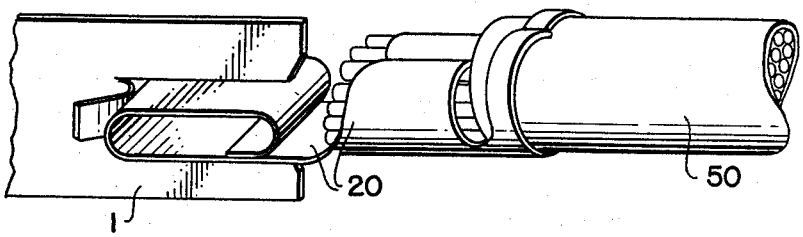
FIG. 5 is a view showing an electric connection of the contact elements depicted in FIGS. 1 and 4, FIGS. 6, 6A, 7, 7A, and 8 are views showing further embodiments of the spring contact element according to the invention, FIGS. 6A and 7A showing cross sectional views through the fastening means of the spring contact element with the cable secured therein.

In FIGS. 4 and 5, a further embodiment of the spring contact element 20 is shown differing therefrom by the incorporation of a support yoke 12 formed by bending the free end 9 of end leg 8 bent about 180° against the base leg 6. The bending radius of support yoke 12 is generally somewhat smaller than the bending radius of the bend between base leg 6 and end leg 8 so that the yoke resiliently supports the same within slot 2 with the legs 6 and 8 being substantially parallel to one another.

Figure 6:
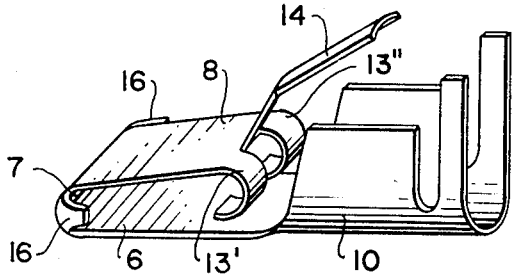
Figure 6A:
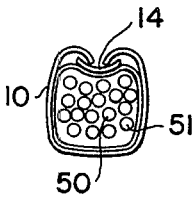

In FIGS. 6 and 6A a further embodiment of spring contact 20 is shown and include two support yokes 13' and 13" which are provided at the outer end of the leg 8 by bending or rolling a certain end length of the free end leg. Between the two support yokes 13' and 13", is a contact tongue 14 extending toward the conductor wrapping means 10 and as seen in FIGS. 6A into contact with the bare ends of the electric conductors. By compressing tongue 14 together with the conductors (51) the same will effecitvely increases the conducting cross section, increase the contact pressure, and protect the conductors when compressing the same together.

Figure 7:
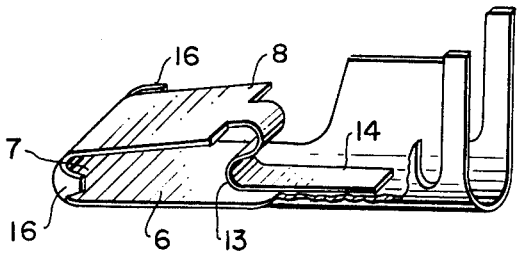
Figure 7A:
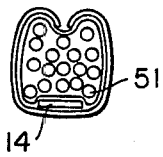

FIG. 7 shows a further embodiment of spring contact element 20 which includes only one support yoke 13 in the middle of free end 9 of end leg 8 while the support yoke passes over into a contact tongue 14 which extends toward the cable wrapping means 10 and will be disposed beneath the conductors 51 of cable 50, as seen in FIG. 7A.

Figure 8:
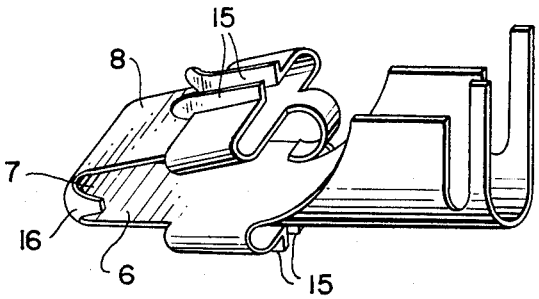

FIG. 8 shows a further embodiment of the spring contact element including, on the outwardly directed contact faces of base legs 6 and/or 8, pairs of contact skids to receive the counter contact element. These contact skids 15 are arranged in the direction of insertion and are flexibly and integrally provided on the side edges of legs 6 and/or 8 and engage the side faces of the legs 3 of the counter contact element 1. At the side edges of bend 7, stop notches 16 project rearwardly towards the cable which engage the interim of the chamber of an insulating case disposed about the contact element for protection of the electric connection as will be apparent hereinafter.

Figure 9:
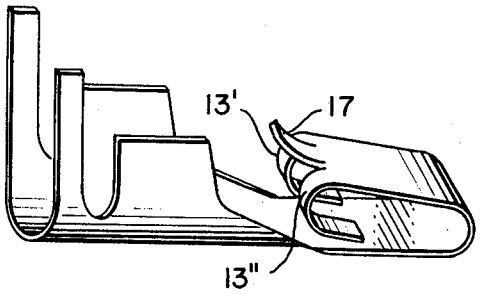
FIG. 9 is a view showing a further embodiment of the spring contact element with two outer rolled-in acute yokes and a notch disposed therebetween.

FIG. 9 shows a further embodiment of the spring contact element similar to that of FIG. 6 including two support yokes 13′ and 13″ and a short stop spring 17 disposed therebetween which locks the spring contact within the chamber of an insulating case.

Figure 10:
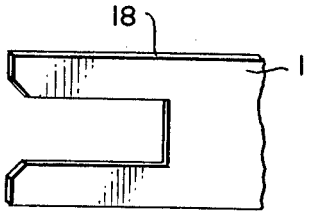
FIG. 10 is a view showing a further embodiment of a counter contact element similar to that as FIG. 1.

FIG. 10 shows a counter contact element comprised of a slotted flat plug 1 which has the advantage that its thickness 18 may be selected in accordance with the desired conducting cross section extending over the greatest part of the width of contact spring 6, 7, 8 of spring contact element.

In FIGS. 13, 14, 16 and 17, there is shown a further embodiment of the spring contact element including a slot 33′, 33″ in the apical portion 7 of the legs 6 and 8 extending adjacent to the middle thereof: the slots 33′ and 33″ extend in the direction of insertion and are arranged, parallel to one another. The inner edges of slots 33′ and 33″ include chamferings 35, 35 and the rear surfaces exclude chamfered faces 36 stop notches 37, 37 are provided, on base leg 6 and/or end leg 8, a predetermined distance from the cable end of slots 33′ and 33″, a pair of contact elements perpendicular to one another. The slots 33′ and 33″, the bending radii of bend 7, the supporting yokes 13′ and 13″, the stop notches 37 are so dimensioned and arranged in their respective contact elements to permit that two identical spring contact elements to be inserted into each other.

Figure 11:
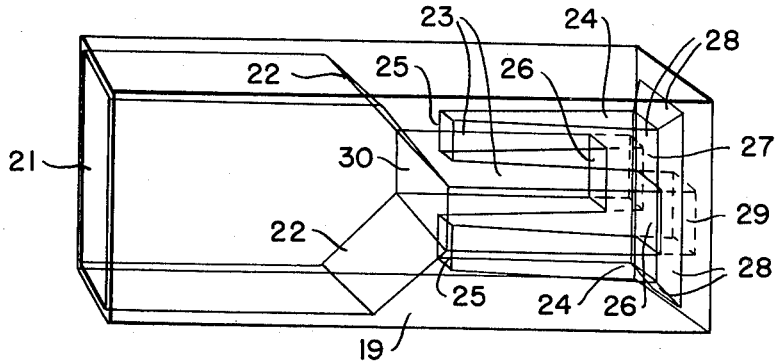
FIG. 11 is a view showing an insulating case in an assembled position to receive the spring contact and counter contact element.

FIG. 11 shows a first embodiment of an insulating case which may be slid on the bare contact elements for protecting the same. Insulating case 19 shown as a transparency is suited to receive the spring contact assembly of FIGS. 9 and 10. The insulating case has a rectangular exterior and includes a first contact chamber 23 to receive spring contact element 20 which is guided through opening 21 via guide chamfering 22 into chamber 23 and a second contact chamber 24 to receive the counter contact element from the rotated about 90° with respect to the first contact chamber with both contact chambers interengaging each other. Stop notch 17 on spring contact element 20 is engaged with in chamber 24 housing counter contact with the front sides 25 thereof projecting towards opening 21 serving as an abutment. To produce the abutment 25, no particularly constructed pin, or portion of a pin, is necessary in the production mold is necessary as the former is produced by the tool pin which forms chamber 24. Spring contact element 20 is from sliding-through by faces 26 of chamber 23 remote from insertion opening 21. The spring contact element is thus housed in contact-proof condition and is mechanically secured by a traction relief formed by stop spring 19 within contact chamber 23. The second contact chamber 24 includes on the second front side an insertion slot 27 provided with chamfering 28. Through insertion slot 27, the plug 1 may be inserted into chamber 24, the electric contact being provided within the space penetrated by the two contact chambers 23 and 24. Contact chamber 24 is tapered towards the end and thus constitutes a good guide for the slotted flat plug 1 which with a view to this shape cannot encounter, when being inserted, the edges or projecting structional portions of spring contact 20.

It is also possible to produce chambers 23 and 24 from the insertion side of the slotted flat plug if the locations shown by dotted lines 29 are produced by the pin portions in the production tool for chambers 23 and 24 as one piece extending to the rectangular opening 30 of the first chamber. In this embodiment, chamber 23 is open towards the second front side and prevention against the sliding-through of the spring contact element is obtained by chamferings 22 which conductor contact wrapping means 10 engage.

The embodiment of the insulating case shown in FIG. 11 is particularly suitable for multi-terminal plug-in connections on slotted switching device insertion tongues in which spring contact elements of the invention according to FIGS. 2, 4, 6, 7, 8, and 9 are employed, wherein good operation function is obtained while require slight insertion forces and minimum production cost.

Figure 12:
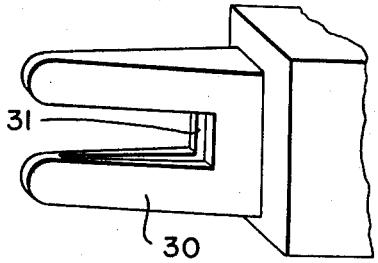
FIG. 12 is a view showing a portion of an insulating case for a counter contact element.
Figure 13:
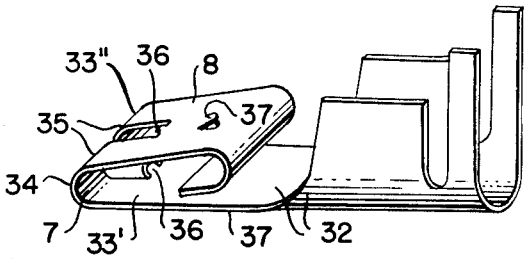
FIG. 13 is a view showing a further embodiment of the spring contact element.
Figure 14:
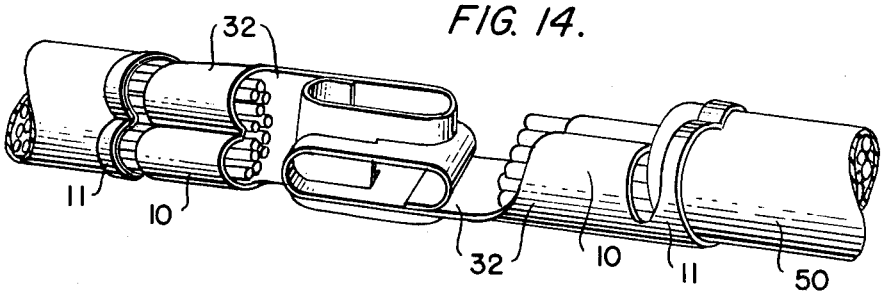
FIG. 14 is a view showing an electric connection of two spring contact elements as shown in to FIG. 13 perpendicularly disposed with respect to one another.
Figure 15:
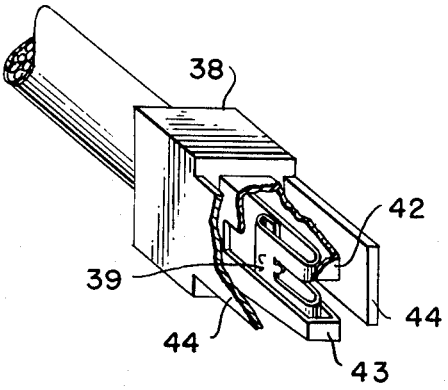
FIG. 15 is a view showing an opened one-terminal insulating case in which the spring contact element of to FIG. 13 has been inserted.
Figure 22:
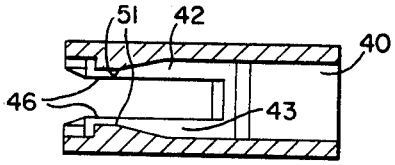
FIG. 22 is a cross sectional view through the contact chamber of an insulating case.
Figure 23:
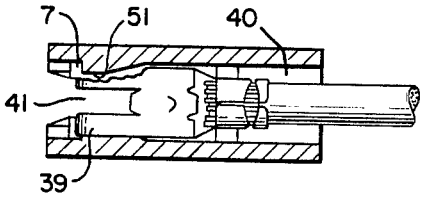
FIG. 23 is a cross sectional view similar to FIG. 22 with the spring contact element positioned therein.
Figure 24:
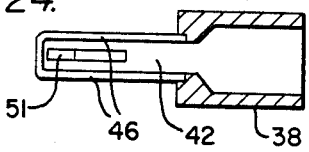
FIG. 24 is a cross sectional view through the contact chamber of the insulating case taken in a plane perpendicular to the cross sectional plane of FIG. 22.
Figure 25:
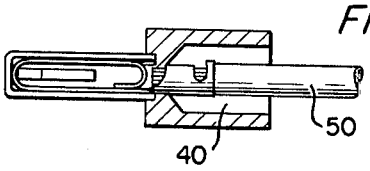
FIG. 25 is a cross sectional view similar to FIG. 24 with the spring contact element positioned therein.

FIG. 12 shows an insulating case portion 30 including a chamber 31 for slotted flat insertion tongue 1. This portion may, depending on the dimensions, be inserted into the insulating case 19 of FIG. 11 and offers additional protection and insulation for the slotted flat tongue and an increased. Similar advantages cannot be obtained for instance in standardized flat plugs.

FIG. 15 and 18 through 25 show illustrations of a further insulating case according to the invention which is preferably manufactured from viscous insulating material. As seen in FIGS. 15, 18, 19, and 22 through 25, the insulating case of the invention comprises a base body 38 of square cross section within of which the spring contact element of FIG. 16 may be inserted. The arms 39, 39 of the spring contact element are vertically disposed in contact chamber 40, which includes four side walls 46, see FIG. 22, facing each other in pairs. The contact chamber 40 receives the spring contact element through the base body 38, and its rectangular interior cross section receives arms of the contact spring contact element maintaining its shape therewithin. Two side walls 46 are provided, with a slot 41 to receive a counter contact element. Slot 41 passes perpendicular to the parallel inner surfaces of the two side walls 46 and extends in the direction of insertion and divides contact chamber 40, into two housings 42 and 43 facing each other and extending in the direction of insertion.

On the sides of cups 42 and 43, a covering wall is provided covering break 41 against the outside.

The faces of cups 42 and 43, directed towards the interior of contact chamber 40, include chamfered stop notches 51 which engage and lack a portion of the contact spring of the springs therewithin. If the individual spring contact elements of FIGS. 9 or 16 and 17 are used, stop springs 17 are provided on the free of end leg 8 and engages, a corresponding counter face in the insulating case.

In the embodiment of the insulating case having a square cross section of the base body 38 as shown in FIGS. 15, 18, 19 and 22 through 25, the outer cross section of the contact chamber 40 is rectangular as are the two housings 42 and 43 which are thin-walled and integral with base body 38 in a plane parallel with the cable axis and to one of the side walls of the base body. The distance between the broken side walls 46 of housings 42 and 43 and of the corresponding covering wall 44 is about the same as the small edge of the outer cross section of contact chamber 40. This permits a second insulating case, the profile of which is identical to that of the first insulating case, to be inserted, after rotating one casing about 90° relative to the first case, to produce a plug-in connection of identical insulating cases.

Covering walls 42 possess a thin rectangular cross section and are preferably provided as an elongation of the side walls of the base body. In the illustration, the long edge of the cross section of the covering walls has so been dimensioned that the covering walls of the upper housing 42 will laterally cover slot 41 as well as lower housing 43.

When inserting the spring contact, see FIGS. 22–28, the chamfered stop notches 51, respectively, are pushed apart by bends 7 of the spring contact elements and thereafter engage the rear surface of bend 7 between base leg 6 and end leg 8 of the spring contact elements. This manner of locking the spring contact elements does not require any stop notches or the like on the spring contact element and has the advantage that it does not impair the freedom of movement of contact springs 6, 7, 8.

FIG. 20 shows a further preferred embodiment of the insulating case, where in both the base body 38 and housings 42, 43 possess a circular outer contour with the radius of the housings being smaller for a predetermined value than the radius of base body 38. The inner contour of cups 42 and 43 facing the interior of contact chamber 40 passes subsequently to the circular outer contour for instance along an inclined plane passing through the cylinder axis and subsequently in parallel to a straight edge of the inner contact chamber cross section. Covering walls 44 are also shaped as a thin-walled circular segment of a constant wall thickness with the radius thereof corresponding to about the radius of the base body and the radius of the inner contour corresponding to about the radius of the outer contour of cups 42 and 43. The circular segment of the outer contours of cups 42 and 43 and of the covering walls 44 has an angle of about 90°.

In accordance with a further preferred embodiment of the insulating case as seen in FIG. 21, the outer contour of base body 38 has the shape of a regular octagon. The outer contour of the housings 42 and 43 has a first outer face staggered parallel to the inside relative to one of the faces of the octagon of the base body for a given distance. The inner contour of the cup passes subsequently to the outer contour for instance along an inclined plane passing through the symmetric axis and subsequently in parallel to the first outer face. The covering walls 44 again possess a thin rectangular cross section and are arranged on an elongation of one outer face of the octagon of base body 38. The thickness of covering walls 44 corresponds to about a given measure for which the first outer face of the two housings 42 and 43 has been staggered to the inside in parallel to one of the octagon faces.

Covering walls 44 and housings 42 and 43 are preferably, in all the embodiments of the insulating case, about the same length. The insulating case consists preferably of viscous plastic material and is made in one piece.

Figure 26:
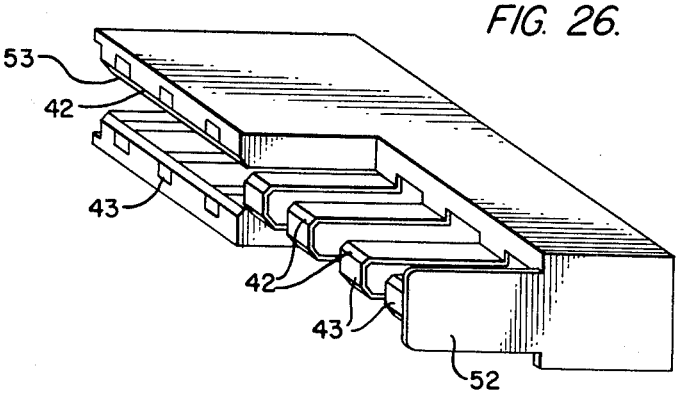
FIG. 26 is a perspective view showing a six-terminal insulating case including six individual insulating cases stacked.

FIG. 26 shows a first embodiment of a multiple housing to receive a plurality of spring contact elements according to the invention. A first group of three individual insulating cases possesses a first given angular position relative to the plug plane. Subsequent to this first group of individual insulating cases, there is provided a second group of three individual insulating cases staggered about 90° relative to the angular position of the first group. In the first group of insulating cases, housings 42 and 43 are integrally connected with one another. In the second group of the insulating cases, the individual housings 42 and 43 of the individual contact chambers 40 are arranged in the direction of the case plane, two adjacent cups 42 and 43 of neighboring individual insulating cases being integrally formed with one another. Instead of the covering walls between the individual insulating cases, there is provided on a small longitudinal side of the housing a guide pin 52 while on the longitudinal side facing this guide pin a corresponding recess 53 for the guide pin is provided. The total arrangement of the two groups of individual insulating cases is so provided that a second housing profile identical to this first housing profile may be plugged, after rotating the same about 180° relative to the plug-in direction, into the first housing profile to provide a multiple plug-in connection.

Figure 27:
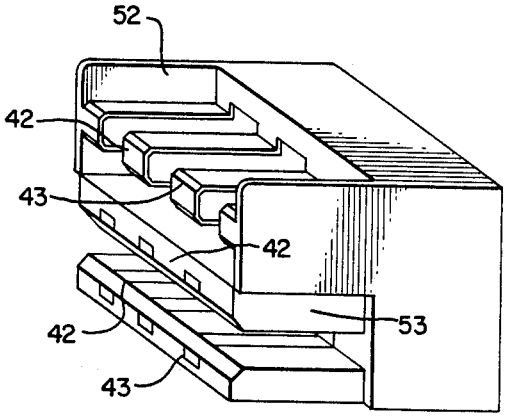
FIG. 27 is a four-terminal insulating case including four individual insulating cases according to the invention, one on top of the other.

In FIG. 27, a further embodiment of a multiple insulating housing is shown wherein a first group of two individual insulating cases is arranged in a first lower plane where the individual insulating cases have a given angular position relative to the plug-in plane. In addition, there is provided a second group of two individual insulating cases in an upper plane where the individual insulating cases are axially staggered about 90° relative to the angular position of the first group. As compared to the arrangement of FIG. 26, the multiple housing of FIG. 27 differs only in that on the two longitudinal sides in the area of the upper plane of the second insulating case group, guide pins 52 have been provided while the recesses 53 corresponding to the guide pins 52 are provided at the level of the lower plane of the first group of the insulating cases immediately below the guide pins. In this embodiment of a multiple housing, the succession of individual insulating cases of the first and the second group is so provided that two identical insulating cases may be inserted into each other provided one of the insulating cases has axially been rotated about 180° relative to the direction of insertion.

In summary, the spring contact elements according to FIG. 9, axially rotated with respect to each other about 90° and shown in FIGS. 16 and 17, are illustrated in a position in which they may also be inserted into an insulating case each according to FIG. 15 or FIGS. 18, 19, or 20 and 21. FIG. 18 shows a perspective view of the insulation case according to FIG. 15 as seen from the insertion side of the insulation case. FIG. 19 shows a corresponding perspective view of an insulating case according to FIG. 15 or FIG. 18 axially rotated about 90°, seen from the front side on the side of the cable, the insertion opening being marked 45. Housings 42 and 43 including the corresponding covering walls 44 have a profile which may receive, as a second coupling portion, an identical profile which is axially twisted about 90° and is facing it on the front side as is the case in the insulating cases depicted in FIGS. 18 and 19. Two insulating cases according to FIGS. 15, or to FIGS. 20 or 21, respectively, may thus be plugged together in the positions according to FIGS. 18 and 19 as a twin plug where two spring contact elements, in the position according to FIGS. 16 and 17, may be received and form an electric connection in the coupled insulating cases. A contact chamber formed by the two coupled insulating cases consists of a horizontal and a vertical half each within which one horizontal and a vertical spring contact element 32 each may be housed and plugged into each other.

I claim:

1. A resilient metallic contact element comprising a resilient elongated conductive strip means for mechanical connection to a cable and electrical connection to a counter contact element;

said strip means having at one end thereof crimpable fastening means for electrically connecting said one end to a cable;

said strip means having a base leg extending outwardly from said fastening means and being reversely bent on itself via a bend having a predetermined radius to provide a leg with a free end disposed at an acute angle to said base leg;

said base leg and said free leg each having a notch therein extending inwardly of said bend toward said crimpable fastening means for a distance to approximately the middle of said free leg;

said notches being symmetrical, having spaced parallel sides and being in vertical alignment with one another with said leg with the free end having its terminal end being reversely bent upon itself by a reverse bend of about 180° to constitute a support yoke means facing said base leg; and a locking tongue means struck out of and raised above the upper surface of said leg with the free end extending toward said crimpable fastening means and located a selected distance from said first mentioned reverse bend.

2. A resilient metallic contact element according to claim 1 wherein said acute angle between said base leg and said leg with a free end corresponds to the reset angle which said leg with a free end possesses when released after it has been bent in the course of the production to contact with said base leg.

3. A resilient metallic contact element according to claim 1 wherein said leg with a free end is the length of said base leg.

4. A resilient metallic contact element according to claim 1 wherein said leg with the free end is bent about 180° against said base leg forming said support yoke means and the bend has a bending radius which is somewhat smaller than the bending radius of the bend between said base leg and said leg with the free end.

5. A resilient metallic contact element according to claim 1 wherein said fastening means includes a conductor wrapping means for mechanically and electrically connecting said fastening means to a bare conductor end of a cable immediately adjacent to said base leg.

6. A resilient metallic contact element according to claim 5 wherein said fastening means further includes insulating wrapping means adjacent to said conductor wrapping means for mechanically securing said fastening means to a cable insulation.

7. A resilient metallic contact element according to claim 5 wherein said wrapping means are provided on the same side as said leg with the free end and extending perpendicular to the plane of said base leg.

8. A resilient metallic contact element according to claim 6 wherein locking tongue means are provided adjacent the edges of said bend defining conical ends.

9. An insulating case for a pair of identical metallic contact elements according to claim 1 wherein a first chamber receives said resilient contact element through an opening in a front side thereof and a second chamber receives said other resilient contact element through an opening in a front side thereof facing said first front side with one side of the cross section of said second contact chamber being perpendicularly disposed against one side of the cross section of said first contact chamber whereby said two contact chambers symmetrically penetrate each other.

10. An insulating case according to claim 9 wherein the front face of said second contact chamber facing the opening in the first front side of said insulating case serves as an abutment for said locking tongue of said spring contact element.

11. An insulating case according to claim 9 wherein said second contact chamber includes on the front side thereof an insertion slot provided with chamferings.

12. An insulating case according to claim 11 wherein the front face of said first contact chamber facing said insertion slot serves as an abutment for said spring contact element introduced through said opening in said first front side of said insulating case.

13. A resilient metallic contact element according to claim 1 wherein said notches, the bending radii of said bend and of said support yoke, and said locking tongue means are so dimensioned and arranged that two identical resilient contact elements may be substantially perpendicularly inserted into each other with said locking tongue means of one of said contact elements being disposed behind said first bend of said other contact element.

14. A resilient metallic contact element according to claim 13 wherein said base leg and said leg with a free end have the same width perpendicularly to the direction of insertion.

15. An insulation case to receive said identical resilient metallic contact elements according to claim 13 wherein each includes a body having one side facing the cable and a contact chamber extending therefrom to receive said spring contact element perpendicular to said one side, said contact chamber being of rectangular cross section and including two side walls facing each other including a space therebetween to receive the other contact element, said space being perpendicular to the parallel interior surfaces of said two side walls in the direction of insertion and divides said contact chamber at the insertion-side end into two housings facing each other and aligned in the direction of insertion.

16. An insulation case according to claim 15 wherein said space is covered on both sides by a covering wall.

17. An insulating case according to claim 16 wherein said housings are flexible.

18. An insulating case according to claim 17 wherein the inner opposing faces of said housings of said contact chambers include stop notches provided with chamferings engaging the rear of said contact springs of said inserted spring contact element.

19. An insulating case according to claim 18 wherein said base body possesses a square outer contour.

20. An insulating case according to claim 19 wherein the outer cross section of each of said contact chamber is rectangular and the said two housings are thin-walled and disposed in a plane parallel to said side walls.

21. An insulating case according to claim 20 wherein said covering walls have a thin rectangular cross section and are shaped as an extension of said side walls of said base body.

22. An insulating case according to claim 21 wherein the said covering walls are of a length to cover said upper housing, said space, and said lower housing.

23. An insulating case according to claim 15 wherein said base body has a circular contour.

24. An insulating case according to claim 23 wherein said outer contour of said two housings has the shape of a circular segment the radius of which is smaller for a given value than the radius of said base body, and the inner contour of the cross section of said housings subsequent to said circular outer contour passes along an inclined plane passing through the cylinder axis and subsequently in parallelism to a straight edge of the inner contact chamber cross section.

25. An insulating case according to claim 24 wherein said covering walls are provided as a thin-walled circular segment of a constant wall thickness and the radius of said outer contour of said covering walls corresponds somewhat to the radius of said base body and the radius of said inner contour to about the radius of said outer contour of said housings.

26. An insulating case according to claim 25 wherein said circular segments of said outer contours of said housings and of said covering walls have an angle of about 90°.

27. An insulating case according to claim 15 wherein said outer contour of the cross section of said base body is shaped as a regular octagon.

28. An insulating case according to claim 27 wherein said outer contour of said two housings includes a first outer face staggered to the inside for a given distance relative to one of the faces of said octagon, the inner contour of the housing cross section adjacent to the outer contour passes along an inclined plane passing through a symmetrical axis and subsequently passes parallel to the first outer contour.

29. An insulating case according to claim 28 wherein said covering walls have a thin rectangular cross section and are an extension of one of the outer faces of said octagon of said base body, with the first outer face of said housings being staggered to the inside in parallelism to one of the octagon faces of said base body.

30. An insulating case according to claim 29 wherein a center angle disposed between the connecting lines from the outer edges of the housing cross section to the symmetrical axis is about 90°.

31. An insulating case according to claim 30 wherein said covering walls and said cups have the same lengths.

32. An insulating case according to claim 31 wherein said insulating case consists of viscous plastic material and is manufactured as one piece.

33. An insulating case according to claim 32 wherein said cups and said covering walls possess a profile which may receive a second coupling portion having an identical profile disposed perpendicular thereto.

34. An insulating case according to claim 33 wherein the whole contact chamber of two insulating cases inserted into each other comprises a horizontal and a vertical half within which a spring contact element may be inserted into each other.

35. An insulating case according to claim 34 wherein a plurality of individual insulating cases may be shaped as an integral housing for a multi-terminal plug-in connection.

36. An insulating case according to claim 35 wherein a plurality of individual insulating cases are arranged parallel one next to the other in one plane.

37. An insulating case according to claim 35 wherein a plurality of individual insulating cases are arranged in one plane and a plurality of said planes of insulating cases are arranged one on top of the other.

38. The insulating cases according to claim 37 wherein a first group of individual insulating cases possesses a given angular position relative to the plug-in plane, a second group of individual insulating cases is staggered about 90° relative to the angular position of said first group and the succession of individual insulation cases of said first and said second group is so provided that a second housing profile identical to said first housing profile may be inserted after rotating the same about 180° around the direction of insertion into said first housing profile to produce a multiple plug-in connection.

* * * * *